United States Patent [19]

Negishi et al.

[11] 4,044,537

[45] Aug. 30, 1977

[54] SPINNING METHOD AND APPARATUS THEREFOR

[75] Inventors: Eizaburo Negishi, Yono; Masanori Negishi, Tokyo, both of Japan

[73] Assignee: Kabushiki Kaisha Negishi Kobyo Kenkyusho, Japan

[21] Appl. No.: 633,004

[22] Filed: Nov. 18, 1975

[30] Foreign Application Priority Data

Nov. 29, 1974 Japan ..... 49-138194

[51] Int. Cl.[2] ..... D01H 1/12

[52] U.S. Cl. ..... 57/58.89; 57/156

[58] Field of Search ..... 57/58.89–58.95, 57/156

[56] References Cited

U.S. PATENT DOCUMENTS

| | | | |
|---|---|---|---|
| 3,119,223 | 1/1964 | Meimberg | 57/58.95 X |
| 3,121,306 | 2/1964 | Cizck et al. | 57/58.89 |
| 3,481,128 | 12/1969 | Landwehikamp et al. | 57/58.95 X |

FOREIGN PATENT DOCUMENTS

| | | | |
|---|---|---|---|
| 288,602 | 1/1971 | U.S.S.R. | 57/58.89 |

*Primary Examiner*—Richard C. Queisser
*Assistant Examiner*—Charles Gorenstein
*Attorney, Agent, or Firm*—Oblon, Fisher, Spivak, McClelland & Maier

[57] ABSTRACT

A sliver formed along an inner surface of an outer rotor is drawn out through a hole of an inner rotor which is concentrically provided in and rotated differentially to said outer rotor, whereby drafting of said sliver is effectuated by the relation between the speed of drawing out said sliver and differential speed between the inner and outer rotors. Furthermore, floating movement of the fibers of said sliver is effectively suppressed by use of plural or one centrifugal disk which is pressed onto said sliver while being revolved at the rim of the inner rotor and subjected to self-rotation on its axis.

4 Claims, 5 Drawing Figures

FIG. 1
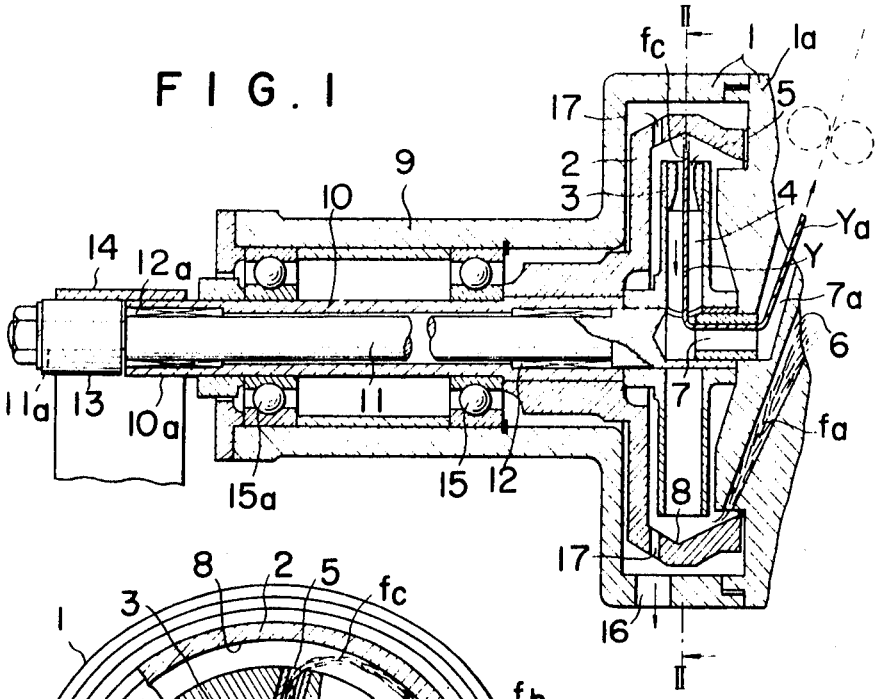
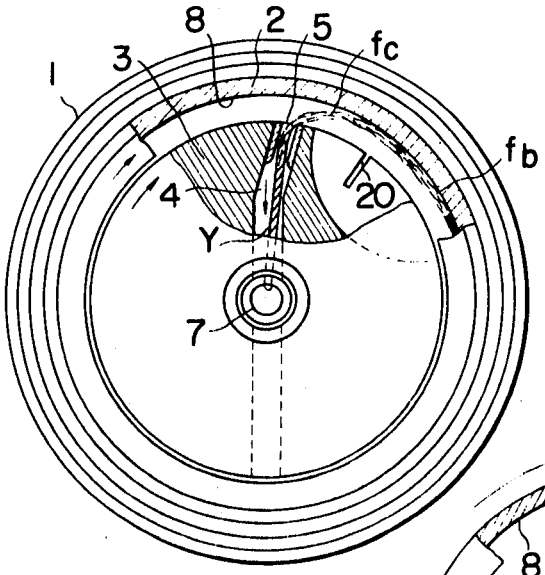
FIG. 2
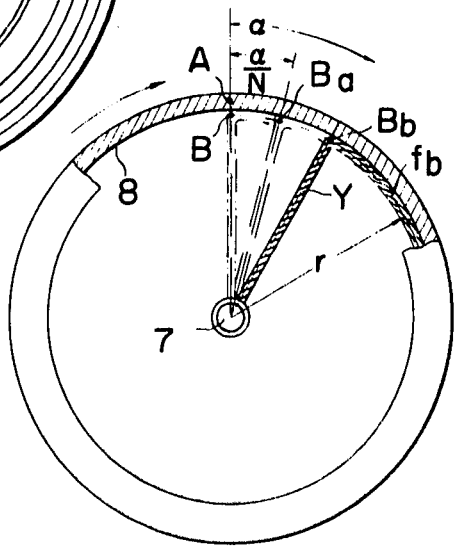
FIG. 3

SPINNING METHOD AND APPARATUS THEREFOR

BACKGROUND OF THE INVENTION

The present invention relates to an open-end spinning method and apparatus comprising outer and inner rotors, and specifically to a draftable open-end spinning method for a sliver formed along an inner surface of said outer rotor and apparatuses therefor.

In the so-called ring spinning method and apparatuses having been conventionally used, winding-up diameter of the yarn wound around a cop or a bobbin is varied in accordance with elevation and lowering of the ring rail, and therefore yarn spinning tension varies remarkably and periodically, thus causing nonuniformity of yarn elongation. Furthermore, yarn character becomes inferior by the friction of the traveler, and there is no further room for further improvement of the apparatus from the viewpoint of elevation of production ability or lower economy.

On the other hand, in the well-known open-end spinning method or apparatuses regarded as the method or apparatus capable of eliminating the disadvantages involved in the ring spinning method or apparatus, there is an excellent characteristic point such that a process for carrying out the roving and winding-turn of the yarn can be omitted, but the tensile strength of the spun yarn is very inferior to that of the standard yarn and excess twist is imparted to the sliver under spinning, thus causing relative narrowness of yarn use or difficulty of spinning fine yarn.

The disadvantages involved in the above-mentioned both types of the spinning method or apparatus are based on the unavoidable result caused by characters and or spinning principles of the apparatuses. Particularly, in the well-known open-end spinning apparatus, the sliver formed along the inner surface of a rotor is merely subjected to twisting while being stripped off from said inner surface and to winding-up into a package, therefore said open-end spinning apparatus is lacking in the drafting ability adapted for correcting the posture of each fiber of the sliver.

SUMMARY OF THE INVENTION

Therefore, it is an object of the present invention to provide an improved open-end spinning method utilizing outer and inner rotors and having an excellent drafting ability for a sliver formed along the inner surface of said outer rotor.

Another object of the present invention is to provide one more open-end spinning method obtained by improving further the above-mentioned improved method so that floating movement of the fibers or sliver to be drafted is suppressed by means of at least one contrifugal disk adapted for pressing and holding the sliver, whereby uniform drafting of the sliver is effectuated, thus causing the possibility of obtaining an excellent yarn and of spinning a yarn finer than in the conventional cases.

A further object of the present invention is to provide an improved spinning apparatus adapted particularly for embodying the improved spinning methods as mentioned above and for carrying out continuously the improved spinning in a super-high speed operation.

The above objects and the other objects of the present invention have been effectively attained by the following method (a) and apparatus (b).

a. Separated fibers are discharged through an optional feeding passage onto an inner surface of an outer rotor so as to be pressed onto said surface and subjected to doubling thereby to form a sliver along said surface, and said sliver is drawn out through a spinning hole opened at its one end toward said sliver, communicated at another end with a central cavity of an inner rotor which is disposed concentrically in said outer rotor, and rotated in differential relation to said outer rotor, said sliver being, if necessary, pressed and held prior to drawing-out of the sliver through said spinning hole thereby to suppress the floating movement of the sliver by means of at least one centrifugal disk, whereby drafting of said sliver is effectuated in response to relation between the speed of drawing out said sliver and differential speed between the inner and outer rotors.

b. The apparatus comprises outer and inner rotors, said outer rotor being attached to one end of a hollow shaft; a casing enclosing therein said outer rotor and having a front cover which is provided with a passage for discharging separated fibers into said outer rotor, an inner rotor provided concentrically in said outer rotor so as to be rotated in differential relation to rotation of said outer rotor, said inner rotor being provided with a central shaft supported rotatably in and through said hollow shaft and a spinning hole formed in one part of said inner rotor, said spinning hole being opened at its one end toward inner surface of said outer rotor and communicated at another end with a central cavity of the inner rotor, and inside of said central cavity being communicated with a yarn guide tube which is provided in said front cover of the casing; and driving means for driving said hollow shaft of the outer rotor and said central shaft of the inner rotor in differential relation to each other.

The features which are believed to have novelty and characteristic matters of the present inventions are set forth with particularity in the appended claims. The inventions themselves, however, both as to their constitutions and modes of operation, together with the further objects and advantages thereof will be best understood from the following detailed description of preferred embodiments read in connection with the accompanying drawings, in which like reference characters designate like parts.

BRIEF DESCRIPTION OF THE DRAWINGS

In the accompanying drawings:

FIG. 1 is a side elevational view in vertical section, showing one embodiment of the apparatus according to the present invention;

FIG. 2 is a front view of the embodiment illustrated in FIG. 1, partially sectioned along a plane II—II shown in FIG. 1;

FIG. 3 is a view adapted for intelligibly describing the spinning principle according to the present invention;

DETAILED DESCRIPTION OF THE PREFERRED EMBODIMENTS

Figure 4:
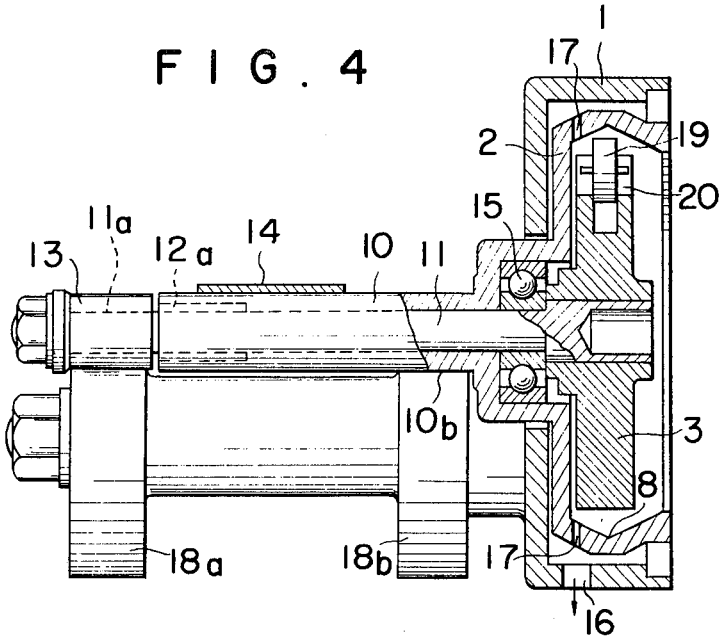
FIG. 4 is a side elevational view showing another embodiment of the apparatus according to the present invention and partially sectioned along a plane IV—IV shown in FIG. 5, from which front cover of the casing is taken out.

Referring now to FIGS. 1 to 4, the improved spinning apparatus according to the present invention will be first described in detail.

One embodiment of the spinning apparatus according to the present invention and shown in FIGS. 1 and 2 comprises an outer rotor 2 attached to one end of a hollow shaft 10 and having an inner surface 8, a disk-shaped inner rotor 3 provided concentrically in said outer rotor 2 and having a central shaft 11 passed through said hollow shaft 10 and supported rotatably by means of bearings 12 and 12*a*, and a casing 1 enclosing therein said outer rotor 2 and having a bearing bracket 9 covering said hollow shaft 10 through bearings 15 and 15*a*, said casing being provided with a front cover 1*a*. The hollow shaft 10 is extended outward at its left end 10*a* from the bearing 15*a* and the central shaft 11 is extended outward at its left end 11*a* from said extended part 10*a* of the hollow shaft 10, said extended part 11*a* of the central shaft 11 being provided with a pulley 13 attached thereto. A driving belt 14 driven by any driving means which is not shown is hung on the pulley 13 and the extended part 10*a* of the hollow shaft 10, whereby the outer and inner rotors 2 and 3 are differentially rotated in the same direction, in accordance with difference between diameters of said extended part 10*a* of the hollow shaft 10 and the pulley 13. The inner and outer rotors can be designed so as to be rotated at conventional high speed such as 20,000–30,000 revolution per minute while maintaining a certain difference between the rotational speeds of the outer and inner rotors.

The front cover 1*a* of the casing 1 is provided with a fiber feeding passage 6 for feeding separated fibers onto the inner surface 8 of the outer rotor 2 which is provided with radial air outlets 17, and the inner rotor 3 is provided with a spinning hole 4 having an inlet 5 directed toward the inner surface 8 of the outer rotor 2, and said front cover 1*a* being further provided with a yarn guide tube 7 and a yarn drawing hole 7*a* communicated with said yarn guide tube 7. The casing 1 is further provided with a radial air outlet 16.

Figure 5:
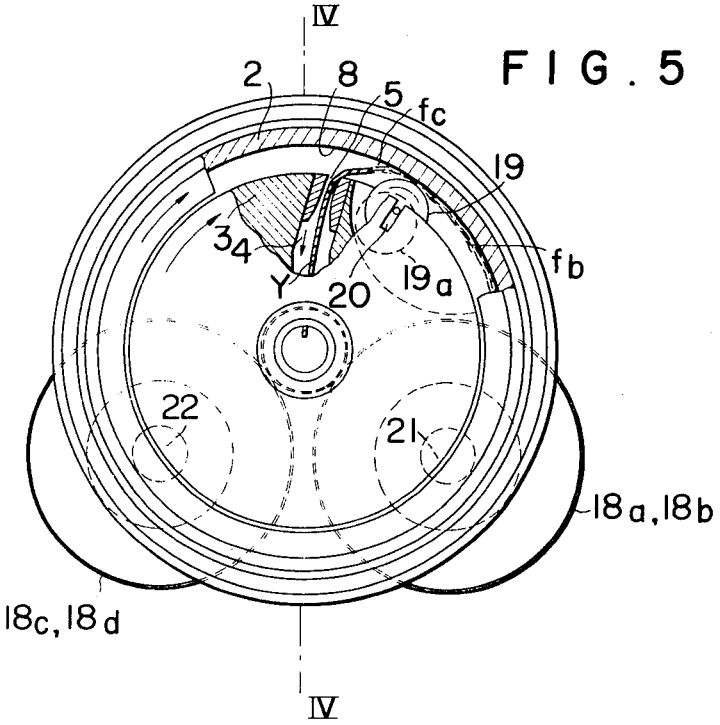
FIG. 5 is a front view of the embodiment illustrated in FIG. 4, sectioned in one part thereof.

FIGS. 4 and 5 illustrate another embodiment of the apparatus according to the present invention, in which the same or equivalent parts as the embodiment illustrated in FIGS. 1 and 2 are designated by the same reference numerals.

In this embodiment, the bearings 15 and 15*a* used for bearing the hollow shaft 10 in the embodiment illustrated in FIGS. 1 and 2 are replaced by bearing means comprising frictional pulleys each having a large diameter corresponding to several times the diameter of the hollow shaft 10. More particularly, a part 10*b* of the hollow shaft 10 and the pulley 13 attached to the extended part 11*a* of the central shaft 11 are supported by two pairs of frictional pulleys (18*a*, 18*b*) and (18*c* and 18*d*), said two pairs being respectively supported by supporting shafts 21 and 22, and two pulleys of each pair being rigidly connected and being aligned in the longitudinal direction of the hollow shaft 10. The driving belt 14 is hung on a part of the hollow shaft 10, whereby the outer and inner rotors 2 and 3 are differentially rotated in accordance with difference between the diameter of the part 10*b* of the hollow shaft 10 and the diameter of the pulley 13 attached to the extended part 11*a* of the central shaft 11. According to the adoption of such bearing means as illustrated in FIGS. 4 and 5 for the purpose of bearing the hollow shaft 10, the apparatus can effectively endure a super high speed such as tens of thousands of revolutions per minute without causing any trouble or damage.

Referring now to FIGS. 1, 2 and 3, the principle of the spinning method of the present invention will be described in connection with the machine illustrated in FIGS. 1 and 2.

The outer rotor 2 and the inner rotor 3 are respectively rotated in the arrow direction as shown in FIG. 2 by driving the driving belt 14 so that the inner rotor 3 leads by a certain rotational difference such as, for example, 50–100 revolutions per minute. Then, separated fibers $f_a$ are fed from the outside, by means of a conventional fiber supplying device which is not shown, onto the inner surface 8 of the outer rotor 2 through the fiber feeding passage 6 of the front cover 1*a* of the casing 1. The fibers fed onto said inner surface 8 are pressed on said surface owing to the suction force caused by the reduction of air pressure at said surface or by the pressure reduction due to exhaust of air from the air outlet 16 through the outlets 17, said pressure reduction being caused by the centrifugal force of the inner and outer rotors, whereby said fibers are successively converted to a sliver while being pressed onto said inner surface and subjected to doubling, thus forming successively a sliver $f_b$ along said inner surface. At this time, when one end of a fetching yarn Y*a* adapted to fetch the sliver $f_b$ is put into the yarn drawing hole 7*a* provided in the front cover 1*a*, said yarn end is automatically sucked into the yarn guide tube 7 and reaches to the inner surface 8 of the outer rotor 2 through the spinning hole 4 and the inlet 5, whereby said sliver $f_b$ is twisted onto and entangled with said fetching yarn Y*a*. Upon occurrence of said twisting and entangling, the fetching yarn Y*a* is drawn out and wound around a bobbin, not shown, through drawing rollers rotated at a certain constant speed, said drawing rollers being conventional means and therefore such are only shown schematically by dotted lines in FIG. 1, whereby the sliver $f_b$ is drawn out through the spinning hole 4, yarn guide tube 7, and yarn drawing hole 7*a* while being subjected to drafting and twisting, thus causing continuous spinning of an excellent yarn having a good quality.

The principle of the spinning method according to the present invention will now be described in detail. Let it be assumed that the sliver $f_b$ being rotated toward arrow direction as shown in FIG. 3 while being pressed onto the inner surface 8 of the outer rotor 2 is drawn out directly through the yarn guide tube 7 in the nondrafted state without passing through the spinning hole 4 as in the case of the conventional open-end spinning apparatus, and the sliver drawing speed, number of revolutions of the outer rotor 2 and rotational radius of the sliver $f_b$ are respectively designated by $v$, $n$ and $r$; the length of the sliver $f_b$ drawn during one rotation of the outer rotor 2, starting from a point A of the outer rotor and returning to said point, then becomes $v/n$.

Accordingly, under the assumption as mentioned above, the yarn forming point B advances just after one revolution of the outer rotor to the point Bb spaced by a distance corresponding to $v/n$ and the angle $\alpha$ between the points B and B*b* becomes as follows.

$$\alpha = (v/n) \times (360/2\pi r)$$

On the contrary, in the spinning method according to the present invention, the sliver $f_b$ is drawn out through the yarn guide tube 7 and yarn drawing hole 7*a* after passing through the spinning hole 4 of the inner rotor 3, and therefore, if the sliver drawing speed and a predetermined magnification factor adapted for a desirable drafting are respectively assumed to be $v$ and N, a desirable differential angle of the spinning hole 4, which advances in accordance with the differential rotation of the inner rotor 3 during the period of time in which the point A of the outer rotor 2 returns to said point A after one revolution of said outer rotor, becomes $\alpha/N$, whereby the yarn forming point B on the spinning hole 4 advances to a point B*a* corresponding to $v/n$N. Accordingly, the tip end of the sliver $f_b$ connected to the yarn forming point B is drafted to a length corresponding to N times the length between the points B and B*a*, whereby a yarn having a desirable length corresponding to the length between the point B and B*b* is drawn out while being imparted with a twist caused by rotation of the inner rotor 3.

The drafting as mentioned above is one indispensably important condition for spinning an excellent yarn having a good quality, because the fibers $f_c$ to be drawn while being connected to the end part of the yarn Y is pullingly drawn while being drafted against the frictional resistance between said fibers $f_c$ and the fibers of one end part of the sliver $f_b$, whereby there is obtained a remarkable effect such that said both kinds of said fibers are naturally corrected in their postures and brought into an effective parallel state. In addition to the effects as mentioned above, resistance of the outside air against the rotation of the yarn Y is almost removed, because the yarn under twisting is surrounded by the inner wall of the spinning hole 4, whereby transmission of the yarn twisting upto the yarn forming point B becomes very easy so as to thereby reduce the yarn spinning tension at said point, thus causing a remarkable reduction of yarn breakage.

In the case of embodying the above-mentioned method according to the present invention, there is an apprehension such that the floating movement of the sliver formed along the inner surface of the outer rotor can occur so as to thereby to cause unfavorable drawing and twisting of the sliver.

According to the present invention, the apprehension as mentioned above can be effectively suppressed by providing a device capable of holding and pressing the sliver from both sides thereof. For example, as shown in FIGS. 4 and 5, at its position near the inlet 5 of the spinning hole 4, there is provided at least one centrifugal disk 19 which is supported in a slot 20 formed in the inner rotor 3, whereby said disk is made to be radially pressed onto the sliver formed along the inner wall surface of the outer rotor owing to the centrifugal force of the inner rotor while being subjected to self-rotation due to friction between said disk and the sliver and while revolving together with said inner rotor so as to thereby to press said sliver between said inner surface of the outer rotor and the disk, thus causing an effective drafting of the sliver while suppressing the floating movement of the fibers or the sliver.

According to the adoption of the sliver holding and pressing device as mentioned above, since the floating movement of the sliver formed along the inner surface of the outer rotor is effectively suppressed, drafting having high uniformity and a magnification factor can be made possible and therefore excellent yarn more superior and finer than the yarn spun by the conventional methods and apparatuses is advantageously obtained.

In the case of embodying the present invention, for obtaining a difference between rotational speeds of the outer and inner rotors, it is not always necessary to make the inner rotor faster than the outer rotor as mentioned already, but the inner rotor may be rotated at a speed slower than that of the outer rotor with the same function and effects. Furthermore, it is not always necessary to use one centrifugal disk 19 for suppressing the floating movement of the sliver formed along the inner surface of the outer rotor, but plural disks may be effectively used, other similar disk or disks may be provided at a position or positions symmetrical to that of the regular disk or disks so as to provide balance to the inner rotor during rotation thereof, or at least one disk made of a permanent magnet may be used so as to hold the sliver between the inner surface 8 of the outer rotor 2 and said magnet disk.

What is claimed is:

1. An open-end spinning method for forming a yarn comprising the steps of:

projecting sliver fibers radially outwardly onto the inner surface of an outer rotor so as to form a sliver;

disposing an inner rotor concentrically within said outer rotor;

providing said inner rotor with a spinning passage, disposed along a radial line and within a radial plane, which is provided with an inlet disposed toward said inner surface of said outer rotor and an outlet disposed along the axis of said inner rotor;

conducting said sliver radially inwardly into said spinning passage of said inner rotor and discharging said sliver through said outlet;

rotating said inner and outer rotors at revolution rates having a predetermined revolution differential defined therebetween, whereby said sliver is twisted and subjected to a predetermined amount of tension; and during the spinning operation, pressing the sliver formed along the inner surface of the outer rotor onto said inner surface by means of at least one centrifugal disk means provided between the inner and outer rotors at a position adjacent the inlet end of the spinning passage of the inner rotor, said centrifugal disk being made to revolve concentrically together with the inner rotor and within the outer rotor and to carry-out self-rotation by press-friction with the sliver which results from said disk being moved centrifugally outward toward said sliver and said outer rotor.

2. A spinning apparatus which comprises:

a stationary casing;

an annular, disk-type outer rotor enclosed by said casing;

a disk-type inner rotor disposed concentrically within said outer rotor;

a driving mechanism for differentially rotating said inner and outer rotors;

at least one centrifugal disk between the inner surface of the outer rotor and the periphery of the inner rotor, said disk being supported so as to be freely urged toward said inner surface of said outer rotor as a result of centrifugal force generated as a result of the rotation of the inner rotor and being self-rotated due to frictional contact with the sliver formed along said inner surface of said outer rotor, whereby said disk presses and holds said sliver against said outer rotor so as to thereby suppress floating of said sliver;

a spinning passage provided within said inner rotor so as to extend radially from the periphery thereof to the axis thereof along a radial line and ithin a radial plane thereof;

an axially disposed yarn guide tube supported by said casing so that the inlet opening of said yarn guide tube is communicated with said axial portion of the spinning passage;

a yarn drawing hole provided through said casing and communicated at its inlet part with the outlet of said yarn guide tube; and said casing being provided with a fiber feeding passage adapted for feeding separated fibers onto the inner surface of the outer rotor.

3. The spinning apparatus as claimed in claim 2, wherein said driving mechanism for differentially rotating the inner and outer rotors comprises:

a hollow bracket integral with said casing;

a hollow shaft, which supports the outer rotor, rotatably supported in and through said hollow bracket by bearing means and projecting outwardly from said hollow bracket;

a central shaft, which supports the inner rotor, rotatably supported in and through said hollow shaft by bearing means and projecting outwardly from the end part of said projecting part of said hollow shaft;

a pulley provided on said projecting end part of said central shaft, the outer diameter of said pulley being made to be slightly different from that of said hollow shaft; and belt means for driving said pulley and the projecting end part of said hollow shaft so that said hollow shaft and central shaft are differentially rotated.

4. The spinning apparatus as claimed in claim 2, wherein said driving mechanism for differentially rotating said inner and outer rotors comprises:

a hollow shaft which supports the outer rotor;

a central shaft, which supports the inner rotor, rotatably supported in and through said hollow shaft by bearing means and projecting outwardly from the end part of said hollow shaft;

a pulley provided around said projecting end part of said central shaft;

at least one pair of pulleys, which are spaced apart from each other in the axial direction of the apparatus and rigidly connected with each other, press-contacted respectively with said pulley provided around the end part of the central shaft and with a surface portion of said hollow shaft, the outer diameter of said central shaft pulley being made to be slightly different from that of said hollow shaft of the outer rotor; and means for rotating said hollow shaft of the outer rotor, whereby the inner and outer rotors are differentially rotated in accordance with said difference between the outer diameter of the pulley attached to the end portion of the central shaft of the inner rotor and the outer diameter of said hollow shaft.

* * * * *

UNITED STATES PATENT AND TRADEMARK OFFICE

CERTIFICATE OF CORRECTION

PATENT NO. : 4,044,537

DATED : August 30, 1977

INVENTOR(S) : Eizaburo Negishi et al

It is certified that error appears in the above-identified patent and that said Letters Patent are hereby corrected as shown below:

Please delete:

"[73] Assignee: Kabushiki Kaisha Negishi Kobyo Kenkyusho, Japan"

and insert therefor:

--[73] Assignee: Kabushiki Kaisha Negishi Kogyo Kenkyusho, Japan--

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademark*